United States Patent [19]

Nishihama et al.

[11] 4,081,571

[45] Mar. 28, 1978

[54] METHOD FOR DEVELOPING ELECTROSTATIC LATENT IMAGES

[75] Inventors: Hitoshi Nishihama, Hirakata; Katsuhiko Gotoda, Osaka; Minoru Motomura, Nara; Takanobu Nakajima, Kashihara; Tatsuo Aizawa, Osaka, all of Japan

[73] Assignee: Mita Industrial Co. Ltd., Osaka, Japan

[21] Appl. No.: 599,953

[22] Filed: Jul. 29, 1975

[30] Foreign Application Priority Data

Aug. 1, 1974 Japan ..... 49-88381

[51] Int. Cl.[2] ..... G03G 13/08; G03G 13/09

[52] U.S. Cl. ..... 427/18; 118/653; 118/657; 355/3 DD; 427/14; 427/47

[58] Field of Search ..... 427/14, 18, 21, 47; 118/637, 653, 657, 658; 96/150; 355/3 DD

[56] References Cited

U.S. PATENT DOCUMENTS

| | | | |
|---|---|---|---|
| 3,552,355 | 1/1971 | Flint | 118/637 X |
| 3,641,977 | 2/1972 | Hudson | 118/637 |
| 3,666,518 | 5/1972 | Luttman et al. | 427/18 |
| 3,703,395 | 11/1972 | Drexler et al. | 427/18 X |
| 3,754,963 | 8/1973 | Chang | 427/14 |
| 3,793,985 | 2/1974 | Hagenbach | 427/14 X |
| 3,834,350 | 9/1974 | Hodges | 118/637 |
| 3,839,992 | 10/1974 | Takahashi | 118/657 X |

OTHER PUBLICATIONS

*IBM Technical Disclosure Bulletin*, "Magnet Configuration For Magnetic Brush Developer," R. J. Hoekzema, vol. 14, No. 9, Feb. 1972 pp. 2787–2788.

*Primary Examiner*—Ronald H. Smith
*Assistant Examiner*—Stuart D. Frenkel
*Attorney, Agent, or Firm*—Sherman & Shalloway

[57] ABSTRACT

Method and apparatus for developing an electrostatic latent image formed on the surface of an electrostatic latent image-bearing material by applying a powdery developer, wherein the surface of a developer-retaining member retaining a layer of the powdery developer thereon is brought into rolling contact with the surface of the image-bearing material in such a relation that a reservoir zone of the developer is formed at least upstream of the zone of rolling contact between the two surfaces, and the developer in the reservoir zone is physically disturbed.

21 Claims, 14 Drawing Figures

METHOD FOR DEVELOPING ELECTROSTATIC LATENT IMAGES

FIELD OF THE INVENTION

This invention relates to a method and apparatus for developing electrostatic latent images using a powdery developer.

DESCRIPTION OF THE PRIOR ART

Methods for developing electrostatic latent images using solid powdery developers have already been proposed. For example, Japanese Patent Publication No. 14798/62 discloses a method for developing electrostatic latent images which involves rotatably providing a permanent magnet in a cylindrical or endless web-like non-magnetic support or plate, rotating the permanent magnet thereby to revolve a powdery developer on the non-magnetic support or plate in a direction opposite to the rotating direction of the permanent magnet and to allow the developer to protrude in a fluffy state at the sites of the magnetic poles, and lightly rubbing the surface of a material having an electrostatic latent image thereon with the protruding parts thereby to develop the latent image. This method makes it possible to reduce fog on the developed image, but at the same time considerably reduces the density of the image. Furthermore, the developer protruding parts cannot be uniformly and continuously brought into frictional contact with the surface of the material containing an electrostatic latent image unless a considerably great difference is provided between the speed of moving the fluffy protruding part of the developer by the rotation of the magnet and the speed of moving the image-bearing material. Accordingly, this method results in the formation of images having specks in a striped pattern. However, when the relative moving speeds of the protruding parts of the developer and the image-bearing material are increased, a partial deceleration or acceleration of the image-bearing material occurs, and causes troubles to the transfer of the image-bearing material. This is especially outstanding when the image-bearing material is in the form of sheet. For example, when the moving speed of the protruding parts of the developer is rendered faster than the transfer speed of the sheet-like image-bearing material and is made lower than the latter between a developing section and transfer rollers provided downstream thereof for conveying the image-bearing material, warping occurs in the sheet-like image-bearing material between the developing section and transfer rollers provided upstream thereof, and causes paper creases or jamming.

U.S. Pat. No. 3,166,432 discloses a method which comprises retaining a layer of a developer consisting only of conductive toner particles on the surface of a conductive developer-retaining member by the van der Waals' force, and bringing the retained developer into rolling contact with the surface of an electrostatic latent image-bearing material in the substantial absence of sliding, thereby to develop the electrostatic latent image on the image-bearing material. This method contributes to the solving of the problem regarding the conveyance of the image-bearing material. However, since it merely brings about a rolling contact between the developer layer and the surface of the latent image-bearing material, the non-uniformity in thickness and density of the developer layer retained on the surface of the developer-retaining material directly results in the non-uniformity of the developed images. It is very difficult, if not impossible, to retain the developer uniformly on the surface of the developer-retaining member, and with the above method, good images free from specks are extremely difficult to obtain.

SUMMARY OF THE INVENTION

It is an object of this invention to provide an improved method for developing electrostatic latent images with a powdery developer, which is free from the defects of the prior art developing methods described above.

Another object of this invention is to provide a method for developing electrostatic latent images to form images having reduced fog, suitable contrast and density, high resolving power and high sharpness.

Still another object of this invention is to provide a developing apparatus which can develop electrostatic latent images excellently with a powdery developer.

A further object of this invention is to provide a developing apparatus for developing electrostatic latent images with a powdery developer as desired in spite of its relatively simple structure and low cost of production.

According to this invention, there is provided a method for developing an electrostatic latent image formed on the surface of an image-bearing material by applying a powdery developer thereto, which comprises bringing the surface of a developer retaining member retaining a layer of the powdery developer on its surface into rolling contact with the surface of said image-bearing material through the developer in such a relation that a reservoir zone of the developer is formed at least upstream of and adjacent to the rolling contact zone of both surfaces, and physically disturbing the developer in said reservoir zone.

The invention further provides an apparatus for developing an electrostatic latent image formed on the surface of an image-bearing material by applying a powdery developer thereto, comprising a developer-retaining member capable of retaining a layer of the powdery developer on its surface, the surface being movable at a predetermined speed, means for feeding the solid powdery developer to the surface of said developer-retaining member at a predetermined position so that the developer-retaining member can have a layer of the developer on its surface, means for bringing the surface of the developer-retaining member into rolling contact with the surface of the image-bearing material through the layer of the developer at a predetermined position downstream of said first-mentioned predetermined position in the moving direction of the surface of said developer-retaining member, said contacting means bringing the two surfaces into rolling contact with each other in such a relation that a reservoir zone of the developer is formed at least upstream of the rolling contact zone of the two surfaces, and means for physically disturbing the developer in said reservoir zone.

The above and other objects and advantages of this invention will become more apparent from the following description taken in conjunction with the accompanying drawings showing some preferred embodiments of this invention.

BRIEF DESCRIPTION OF THE DRAWINGS

FIGS. 8-1 to 8-4 are diagrams showing the relation between the density (H) of the developed image and the minimum distance (d) from the surface of the developer-retaining member to the surface of the image-bearing material.

DETAILED DESCRIPTION OF PREFERRED EMBODIMENTS

The present invention will be described in detail below with particular reference to an electrophotographic copying machine, shown in the accompanying drawings, which is operated in accordance with a method comprising directly developing an electrostatic latent image on a photosensitive paper having a photoconductive layer containing zinc oxide and a resin. It should be noted, however, that the invention is not limited to this method alone, but can be applied to any electrophotographic copying machines based on various other methods such as a method which comprises developing an electrostatic latent image formed on a photosensitive sheet having a photoconductive layer of selenium or cadmium sulfide and then transferring the visible image developed to a suitable transfer paper, or a method which comprises transferring the electrostatic image on the above photosensitive sheet to a transfer paper and then developing the latent image on the transfer paper.

Figure 1:
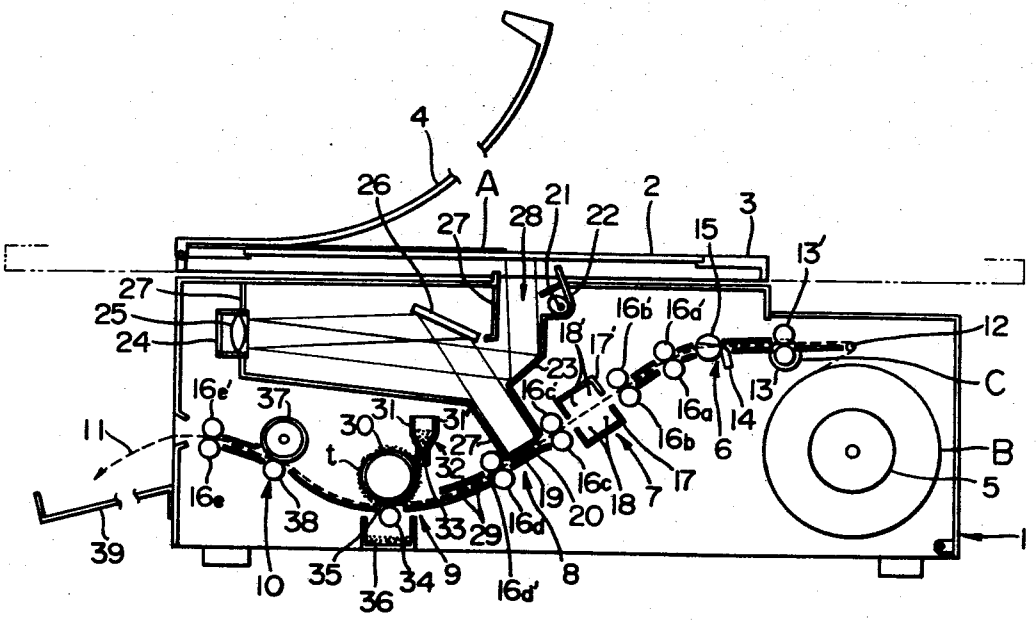
FIG. 1 is a simplified view of an electro-photographic copying machine equipped with the developing apparatus of this invention.

Referring to FIG. 1, an electrophotographic copying machine to which the invention is applicable includes a housing 1 which has at its top a moving frame 3 equipped with a transparent plate 2 for placing an original A thereon. A pressing plate 4 for urging the original A onto the transparent plate 2 is provided in the moving frame 3. The moving frame 3 is supported on the top of the housing 1 via a roller (not shown) so that it may be reciprocable horizontally. It is horizontally reciprocated by a suitable drive means, such as an electric motor, which is rotatable in two opposite directions.

The housing 1 further includes a passageway for transferring a photosensitive paper, as shown at 11, which is provided with a supply reel 5 having inserted therein a roll of photosensitive paper B, a cutter device 6 for cutting the photosensitive paper, an electrically charging device 7, an exposing section 8 for exposing the photosensitive paper, a developing section 9 for developing the exposed photosensitive paper and a fixation section 10 for fixing the developed photosensitive paper, in this order.

Above the supply reel 5 is located a guide roller 12 for leading the photosensitive paper B. Between the guide roller 12 and the cutter device 6, a pair of driven paper-feeding roller 13 and 13′ are provided which include a paper-feeding clutch C that is actuated at the start of the copying operation. The cutter device includes a cutting mechanism consisting of a fixed blade 14 and a rotary blade 15. The rotary blade 15 is rotated by the actuation of a cutter solenoid (not shown) so as to cut the photosensitive paper B passing between the fixed blade 14 and the rotary blade 15. By dint of a known control mechanism (not shown), the photosensitive paper B is cut to a length corresponding to the length of the original A. Downstream of the cutter device 6, a pair of normally driven transfer rollers 16*a* and 16*a*′ for transferring the photosensitive paper are provided. The charging device 7 consists of shield cases 17 and 17′ provided opposingly between a pair of drive rollers 16*b* and 16*b*′ and a pair of drive rollers 16*c* and 16*c*′, and corona discharge electrodes 18 and 18′ provided in these shield cases, and imparts a uniform electrostatic charge to the photoconductive layer of the photosensitive paper B.

In the exposing section 8, a transparent plate 19 and a guide plate 20 are provided opposedly between a pair of drive rollers 16*c* and 16*c*′ and a pair of drive rollers 16*d* and 16*d*′. Furthermore, within the housing 1, an optical system is fixed which optically connects the exposing section 8 to the transparent plate 19 and forms an image of the original A on the photosensitive paper B. The optical system consists of a light projector equipped with a light source 21 and a reflecting wall 22, a reflecting mirror 23, a lens 25 having an in-mirror 24, a lens housing 27 for supporting a reflecting mirror 26 and the transparent plate 19, and an exposure opening 28 for exposing the original A formed between the upper end of the reflecting wall 22 and the forward end of the upper wall of the lens housing. The movement over the exposure opening 28 of the original A placed on the transparent plate 2 is synchronized with the movement of the photosensitive paper B past the transparent plate 19 of the exposure section 8. The image of the original A reaches the transparent plate 19 through the reflecting mirror 23, the lens 25, the in-mirror 24 and the reflecting mirror 26 and is formed on the charged photoconductive layer of the photosensitive paper B. Thus, an electrostatic latent image corresponding to the image of the original A is formed on the photosensitive paper B. Downstream of the drive rollers 16*d* and 16*d*′, a pair of guide plates 29 are provided.

The developing apparatus in accordance with this invention is disposed within the developing section 9. As will be described below in further detail, this developing apparatus includes a cylindrical developer-retaining member 30 having a solid powdery developer retained on its surface. The surface of the developer-retaining member 30 is moved at a speed substantially equal to the moving speed of the surface of the photosensitive paper B on which the electrostatic latent image is formed, and is brought into contact with the surface of the photosensitive paper B via the developer *t*. Above the developer-retaining member 30 is disposed a developer feeding device 32 including side walls 31 and 31′ and an opening at its lower end and containing a developer therein. A means 33, such as a plate, for adjusting the amount of the developer to be retained on the developer-retaining member 30 is secured to the lower end of the side wall 31′. Beneath the developer-retaining member 30, a guide roller 34 for guiding the photosensitive paper is provided, and forms a developing passageway 35 between it and the developer-retaining member 30. A receiving tray 36 is provided beneath the guide roller 34 so as to collect the developer which has dropped off from the surface of the developer-retaining member 30. Thus, while the photosensitive paper having formed on its surface an electrostatic latent image is passing through this developing passageway 35, the latent image on the photosensitive paper is developed. Since the developer-retaining member 30 is rotated so that the speed of its surface is substantially equal to the moving speed of the photosensitive paper B, the photosensitive paper B is neither decelerated nor accelerated in the developing section 8. Accordingly, no trouble is caused to the transfer of the photosensitive paper B.

In the fixing section 10 downstream of the developing section 9, there is provided a fixing means composed, for example, of a heated roller 37 equipped with a metallic cylinder and a heater disposed therein and a pressure roller 38 urged against the heated roller 37. When the photosensitive paper having the developed image thereon passes the contacting position between these two rollers 37 and 38, the developed image is fixed. When a pressure-sensitive developer is used, the roller 37 may be a heatless roller so that the fixing is accomplished by pressure. Driven discharge rollers **16*e* and 16*e'* are provided downstream of the fixing section 10 so that the photosensitive paper having the developed and fixed image is discharged onto a copy receiving tray 39**.

The developing method and apparatus in accordance with this invention will be described in detail with reference to FIGS. 2 to 10.

Figure 2:
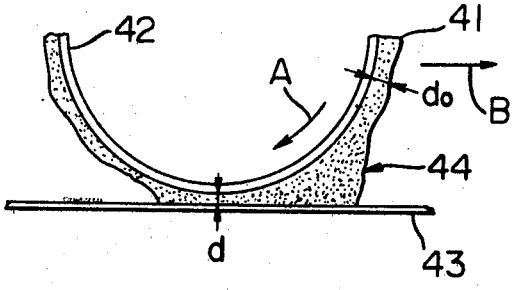
FIG. 2 is a simplified view for illustrating the principle of this invention.

Referring to FIG. 2, a developer-retaining member 42 retaining a powdery developer 41 on its surface by a suitable method is brought into rolling contact with the surface of an electrostatic latent image-bearing material 43 through a layer of the developer 41 retained on its surface. As described in the above-cited U.S. Pat. No. 3,166,432, this rolling contact induces on the developer retained on the surface of the member 42 an electric charge which is of the opposite polarity to the charge on the surface of the latent image-bearing material, and consequently, the developer adheres to the surface of the image-bearing material correspondingly to the electrostatic latent image.

The term "rolling contact", as used in the present application, means that the surface of the retaining member 42 is successively brought into contact with the surface of the image-bearing material 43 through the layer of the developer 41 in the substantial absence of sliding by, for example, rotating the developer-retaining member 42 in a direction of arrow A while keeping the image-bearing material 43 stationary, and moving it in parallel to the image-bearing material 43 in a direction of arrow B at substantially the same speed as the speed of the surface of the retaining member 42; or by rotating the developer-retaining member 42 in the direction of arrow A and moving the image-bearing material in a direction opposite to arrow B at substantially the same speed as the speed of the surface of the retaining member 42.

The developer 41 may be a one-component developer consisting of a single electrically conductive or insulating powder in a size of 1 to 70 microns, preferably 5 to 20 microns which is prepared by covering a powder of iron, nickel, an oxide of iron or nickel, garnet, or an alloy or mixture of these with a resin such as an epoxy, styrene or olefin resin, and if desired, adding a suitable coloring agent such as carbon black. However, the developer that can be used in this invention is not limited to the above-illustrated species, but, for example, two-component developers consisting of toner particles composed of coloring agents and resins, and carriers, which are known to those skilled in the art, can also be used.

The developer can be retained on the surface of the developer-retaining material 42 by various methods. For example, a woven cloth or felt is bonded onto the surface of the retaining member, or mesh-like depressed and raised portions are provided on the surface so as to carry the developer. Or the surface of the retaining member 42 is covered with an insulated material having a relatively high resistivity and the insulated material is charged by a known method to adhere the developer to the surface of the insulated material. Alternatively, a magnetic brush of the developer is formed on the surface of the developer-retaining member 42. The last-mentioned method is preferred because it is simplest and highly reliable.

The developer-retaining member 42 is made of an electrically conducting material which may be electrically insulating itself or have an insulating coating on its surface, and it can be grounded or kept at a suitable potential. When the developer is a relatively electrically conductive (with a resistivity of not more than about $10^{13}$ ohms.cm, preferably not more than $5 \times 10^{11}$ ohms.cm) one-component developer, advantages mainly in regard to fog and surface strength can be obtained by forming on the surface of the developer-retaining member an organic coating such as polyethylene terephthalate, an inorganic coating, a metal oxide coating such as aluminum oxide, or a coating of a mixture of the above substances (for example, the surface of aluminum is oxidized to form a coating of alumina thereon, and then impregnating the aluminum with a resin such as polyethylene terephthalate to remove pinholes caused by the formation of alumina), preferably a relatively insulating metal oxide coating having a resistivity of $10^3$ to $10^9$ ohms.cm, preferably $10^4$ to $10^7$ ohms.cm.

These advantages include the following.

(a) When an electrically conducting retaining member is used, the developed image tends to become hard with high contrast, and the reproducibility of halftones becomes poor. But when the retaining member having a relatively insulating surface coating is used, images having appropriate contrast can be obtained, with good reproducibility of halftones.

(b) Fog in the background area of the developed image can be reduced to a greater extent by using the retaining member having a relatively insulating surface coating.

(c) When the retaining member having a relatively insulating surface coating is used, better results can be obtained when the surface potential of the electrostatic latent image-bearing material is lower. When the surface potential is larger, there is a tendency that the developer gathers on the edge of the image. Accordingly, good images can be obtained by using an electrostatic latent image-bearing material with a small amount of a photoconductive layer coated thereon, and an exposure light source which permits the use of reduced power.

The developer-retaining member 42 may be of any shape so long as it can make rolling contact with the image-bearing material 43 through the developer layer 41. For example, it is a rotatable cylinder, a part of cylinder or an endless belt.

In the conventional developing method based on mere rolling contact, the surface of an electrostatic latent image-bearing material is caused to contact the surface of a layer of a powdery developer maintained on the surface of the retaining member without substantially causing changes in the thickness of the layer. In other words, the thickness ($d_o$) of the developer layer and the shortest distance ($d$) between the surface of the developer-retaining member 42 and the surface of the image-bearing material 43 are prescribed in the relation $d=d_o$. Accordingly, the non-uniformity in the thickness and density of the developer layer on the surface of the developer-retaining member appears directly in the resulting image, and there can only be obtained images which have specks and a coarse surface texture. Thus, the conventional developing method based on mere rolling contact has been precluded from widespread acceptance because of the difficulty of affording images being free from specks and having a fine surface texture.

In order to overcome this difficulty, the developing method of this invention causes the surface of the developer-retaining member to make rolling contact with the surface of the electrostatic latent image-retaining material through the developer so that a reservoir zone for the developer is formed at least upstream of the rolling contact portion of the two surfaces, that is, the portion at which the two surfaces make the closest contact. According to the developing method of this invention, the shortest distance ($d$) between the surface of the developer-retaining member 42 and the surface of the electrostatic latent image-bearing member and the thickness ($d_o$) of the layer of the developer 41 before the developer 41 makes contact with the surface of the image-bearing material are preset in the relation $d_o>d$ at the time of rolling contact of the surface of the developer-retaining member 42 with the surface of the image-bearing material 43 through the developer 41. When there is a local non-uniformity of adhesion of the developer to the surface of the developer-retaining member 42, $d_o$ is defined to represent the thickness of that part of the developer layer at which the amount of adhesion is smallest, and $d_o$ and $d$ are prescribed as follows: $d_o \geqq d$. Hence, according to the method of this invention, the surface of the developer-retaining member 42 is brought into rolling contact with the surface of the image-bearing material through the layer of the developer 41 in a relation expressed by $d_o \geqq d$. When the surface of the image-bearing material 43 and the developing layer 41 make such a rolling contact in the relation $d_o \geqq d$, the developer in an amount corresponding to $d_o-d$ forms a reservoir zone 44 at least upstream of the rolling contact zone. This reservoir zone 44 spontaneously disappears as a result of the developer being carried away by the retaining member 42 upon the releasing of the rolling contact between the retaining member 42 and the image-bearing material 43.

As described hereinabove, the developing method of this invention is characterized in that the surface of the developing-retaining member is brought into rolling contact with the surface of the image-bearing material in the prescribed relation through the developer thereby to form a reservoir zone of the developer at least upstream of the rolling contact zone of the two surfaces. The formation of the reservoir zone obviates the occurrence of specks on the developed images which is caused by the non-uniformity of the thickness and density of the developer layer retained on the surface of the developer-retaining member.

Desirably, the developer within the reservoir zone formed upstream of the rolling contact zone is disturbed physically by various magnetic, electrical, mechanical or acoustical methods. Our investigations have led to the discovery that images of higher density can be obtained when the degree of disturbance is larger. This is considered to be due to the increase of the length of contact between the developer and the image-bearing material and the increase of the frequency of contact between the developer and the electrostatic latent image formed on the surface of the image-bearing material 43. This disturbance is believed to cause the developer to make an irregular motion in the reservoir zone 44, and therefore, the coarse surface texture of the images can be removed. Our experiments also show that if the reservoir zone 44 spreads too far on the downstream side of the rolling contact zone (that is, on the side where after rolling contact, the developer 41 separates from the image-bearing material), the resolving power and sharpness of the resulting image become somewhat poor, and fog density tends to increase, but that no serious degradation of the image is caused.

Figure 3:
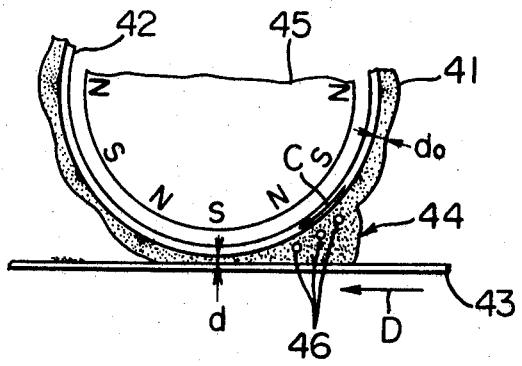
FIGS. 3 to 6 are simplified sectional views of the developing apparatus of this invention.

Referring to FIG. 3, an embodiment of the developing apparatus of this invention will be described in which the developer is magnetically retained on the surface of the developer-retaining member 42, and the developer within the reservoir zone 44 is distributed by a mechanical method. In the developing apparatus of FIG. 3, a magnet 45 is fixed stationary inside a cylindrical developer-retaining member 42 made of a non-magnetic material having an insulating surface coating, and the powdery developer 41 is retained on the surface of the retaining member 42 by the magnetic force of the magnet 45. The retaining member 42 is rotated in a direction of arrow C, and the image-bearing material is moved in the direction of arrow D at the same speed as the surface speed of the retaining member 42. The shortest distance ($d$) between the surface of the image-bearing material 43 and the surface of the developer-retaining member and the minimum thickness ($d_o$) of the developer layer 41 before the contact of the developer 41 with the image-bearing material 43 are preset in the relation $d_o \geqq d$. Then, the surface of the developer-retaining member 42 is brought into rolling contact with the surface of the image-bearing material 43 through the layer of the powdery developer 41, whereby the reservoir 44 for the developer is formed upstream of the zone of rolling contact between the surface of the developer-retaining member 42 and the surface of the image-bearing material 43. In order to impart a physical disturbance to the developer in the reservoir zone 44, a means 46 for imparting mechanical disturbance made of fine metal wires with a diameter of 0.1 to 3 mm which may be merely fixed or kept vibrating by a suitable means (not shown) is provided near the surface of the developer-retaining member. The position and shape of the means 46 are not limited to those illustrated so long as it imparts a turbulent flow to the developer. The material which makes up the means 46 may be a conducting or dielectric material. When the developer-retaining member has an insulating surface coating with a considerable thickness, the use of a conductor as the means 46 can afford good images free from an edge effect. After the rear end of the image-bearing material 43 has passed the rolling contact zone and the development is over, the developer forming the reservoir zone 44 is attracted by the magnet 45 and moves according to the rotation of the developer-retaining material 42.

The roughness of the surface of the developer-retaining material differs according to the developer used. For example, in order to prevent a two-component developer from slipping on the surface of the developer-retaining member, knurling may be applied to the surface of the developer-retaining member. When a one-component developer is used, the amount of the developer retained on the surface of the developer-retaining member is generally small. Accordingly, greater surface roughness results in coarser surface textures of the image. Preferably, therefore, the surface roughness of the developer-retaining member is not more than 12 S.

Another embodiment of the developing apparatus of this invention will be described by referring to FIG. 4.

A roll-like magnet 47 is disposed inside the developer-retaining member 42 consisting of a non-magnetic cylinder. The roll-like magnet 47 and the developer-retaining member 42 are so provided that they can rotate independently from each other around a shaft 48. Above the developer-retaining member 42, a developer feeding means such as a developer container 49 is provided in order to feed the developer to the surface of the developer-retaining member 42.

Preferably, the width ($l$) of the feed opening of the developer container 49 is usually about 2 to 80 mm although it varies according to the flowability or particle size of the developer 41. When the image-bearing material 43 is transferred in a direction of arrow D at a speed V, and the developer-retaining member 42 is rotated in a direction of arrow E so that its surface speed becomes substantially the same as the surface of the image-bearing material 43, the surface of the image-bearing material 43 makes a rolling contact with the surface of the developer-retaining member through the layer of the developer 41. In this embodiment, too, the minimum distance ($d$) between the surface of the developer-retaining member 42 and the surface of the image-bearing material 43 and the minimum thickness ($d_o$) of the developer layer before the contacting of it with the image-bearing material 43 are prescribed in the relation $d_o \geqq d$. Accordingly, a reservoir zone 44 for the developer is formed during the rolling contact at a position at least upstream of the rolling contact zone. The minimum thickness ($d_o$) of the developer 41 before the rolling contact is adjusted according to the distance ($a$) between the lower edge of a means 50 such as a plate provided, downstream of the rotating direction of the developer-retaining member 42, at the developer feed opening located at the lower end of the developer container 49.

The distance ($a$) varies according to the size of the developer particles, but when using ordinary developers, it is set at 0.1 to 2 mm, preferably 0.3 to 1.0 mm. When the particle size of the developer is not more than 10 microns, the distance ($a$) is desirably adjusted to not more than 0.7 mm. However, when the distortion of the surface of the cylindrical member is considered, the distance ($a$) should desirably be adjusted to at least about 0.1 mm. For example, when the distance ($a$) is set at 0.5 mm, the minimum thickness ($d_o$) of the developer 41 before the rolling contact is about 1.25 mm. The position at which the minimum thickness ($d_o$) exists corresponds to a position halfway between magnetic poles on the surface of the roll-like magnet 47. At the site of the magnetic pole, the developer slightly rises to provide a thickness of about 1.75 mm. In the present invention, the rising of the developer at the site of the magnet is not important.

When the developer 41 is thus applied to the surface of the developer-retaining member 42, the distance ($d$) between the surface of the developer-retaining member 42 and the surface of the image-bearing material is preferably set at not more than 1.25 mm. The developer in the reservoir 44 formed by the rolling contact is magnetically disturbed by rotating the roll-like magnet 47. In order to disturb the developer magnetically, it is preferable to rotate a roll-like magnet having opposite polarities arranged alternately on its periphery. The rotating direction of the roll-like magnet 47 is optional, but the direction shown by arrow F is advantageous in regard to the sharpness of the resulting image.

The larger number of revolutions brings about a greater degree of disturbance, and the number of revolutions is determined according to the number of poles of the roll-like magnet, the flux density of each pole and the moving speed of the electrostatic latent image-bearing member. Usually, magnets having at least 6 poles are preferred. If the number of poles is not more than 4, the surface of the copied image becomes coarse unless the number of revolutions of the roll-like magnet 47 is increased extremely or the moving speed of the image-bearing member is decreased extremely. Preferably, the flux density of the magnet is usually at least 500 gauss on the surface of the developer-retaining member. When it is less than 500 gauss, the force to retain the developer is weakened, and fog in the background area of the copied image increases. On the other hand, when the magnetic flux density exceeds 1000 gauss, the size of the roll-like magnet naturally becomes too large, and this is of course disadvantageous in providing a compact device.

Still another embodiment of the developing apparatus of this invention will be described by reference to FIG. 5. In FIG. 5, the developing apparatus includes a guide plate 52 for guiding a sheet-like electrostatic latent image-bearing material 51 so that it passes through a curved path around a part of the developer-retaining member. The developer-retaining member 42 and the roll-like magnet 47 are the same as those of the developing apparatus shown in FIG. 4. The sheet-like image-bearing material 51 is inserted between the developer-retaining member 42 and the guide plate 52. The distance between the guide plate 52 and the surface of the developer-retaining member 42 is so preset that while the back surface of the bearing material 51 contacts the surface of the guide plate 52, the distance ($d$) between the surface of image-bearing material 51 and the surface of developer-retaining member 42 is smaller than the minimum thickness ($d_o$) of the developer layer on the surface of the developer-retaining member 42 before the rolling contact of it with the surface of the image-bearing material. In the developing apparatus shown in FIG. 5, the lower end of the side plate of the developer feed opening on its upstream side forms a means for adjusting the amount of the developer to be retained by the developer-retaining member 42. Desirably, the guide plate 52 is curved near the rolling contact zone substantially concentrically with the surface of the developer-retaining member 42, and raised and depressed portions are formed on its surface. The raised portions are formed so that the relation $d_o \geqq d$ is met. The distance ($d_p$) between the developer-retaining member 42 and the bottom of the depressed portions and the maximum thickness ($d_m$) of the developer layer which takes into consideration the nonuniformity of the developer on the surface of the developer-retaining material 42 prior to rolling contact are preset in the relation $d_p \geqq d_m$. By meeting this relation, the developer reservoir zone 44 is formed only when the developer makes rolling contact with the image-bearing material. After the end of development, the developer in the reservoir zone is returned to the developer container by the rotation of the developing roller along these depressed portions. If there is no such depressed portion, the developer would always form the reservoir zone 44, and the insertion of the sheet would be impeded by the developer in the reservoir zone. The raised portion may be of any desired shape so long as it has a constant height, does not impede the movement of the sheet and does not accumulate the developer locally. For example, a number of cap-like projections with a constant height may be provided at random, or filamentary projections may be provided parallel to the rotating direction of the developing roller. A comb-like guide plate having depressed portions punched out may also be employed. The guide plate may be made of a metallic or non-metallic material, but in order to prevent the soiling of the back surface of the sheet, it is preferably made of an electrically conducting material.

A further embodiment of the developing apparatus of this invention will be described below by referring to FIG. 6. In the developing apparatus of FIG. 6, a guide plate 53 for guiding the insertion of the sheet-like image-bearing material and a guide roller 54 are provided instead of the guide plate 52 of the developing apparatus shown in FIG. 5. This is more advantageous for sheet transfer. The insertion-guiding plate 53 is made in a comb-like form, and the guide roller 54 is a roller containing depressed and raised portions with the raised portions having a constant height. For example, the guide roller 54 may be one shown in FIG. 7 which has a plurality of raised portions of equal height disposed at intervals. The raised portions may have an optional sectional shape such as a rectangular, arch or trapezoidal shape. The guide roller 54 is rotated so that the peripheral speed of the raised portions is equal to the peripheral speed of the surface of the developer-retaining member 42. The distance (*d*), the distance (*c*) between the surface of the raised portions of the guide roller 54 and the surface of the developer-retaining member 42, the minimum distance (*b*) between the guide plate 53 and the developer-retaining member 42, and the minimum thickness ($d_o$) of the developer layer on the surface of the developer-retaining member 42 before the rolling contact of the developer-retaining member are preset in the relation $d_o \geqq a, b, c$. When the sheet-like image-bearing material is inserted along the insertion-guiding plate 53, a reservoir zone for the developer is formed since $d_o$ is not less than *b*. The developer in the reservoir zone is disturbed by rotating the roll-like magnet 47 in a direction of the arrow. Generally, the degree of disturbance is larger with larger number of revolutions of the roll-like magnet, and the density of the images becomes higher.

Figure 4:
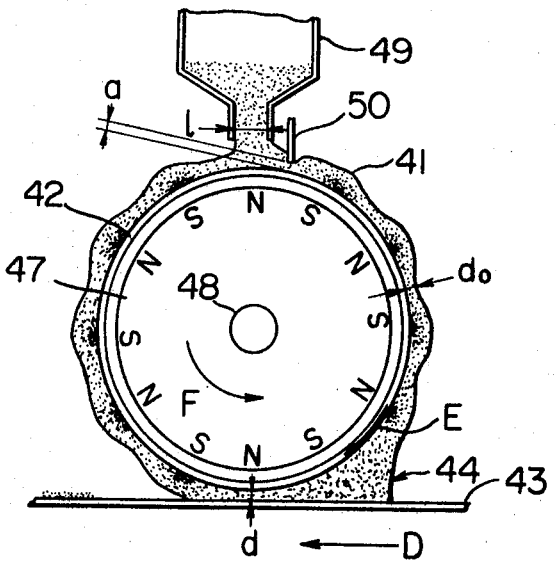
Figure 5:
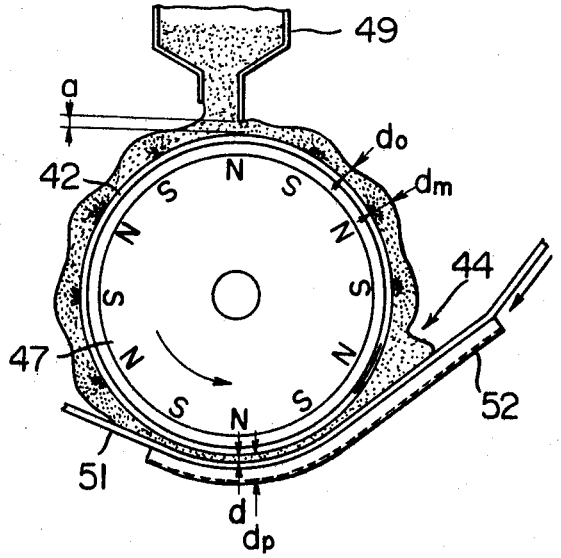
Figure 6:
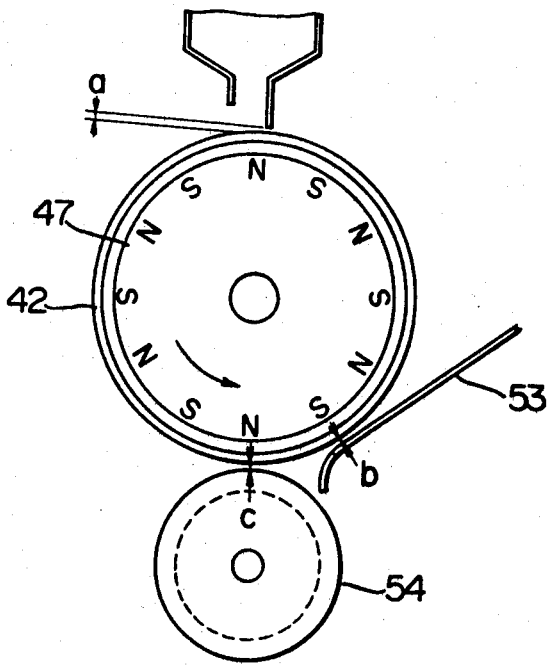
Figures 1, 8:
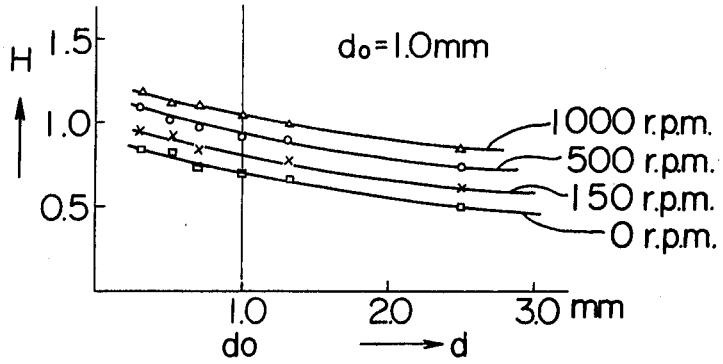
Figures 2, 8:
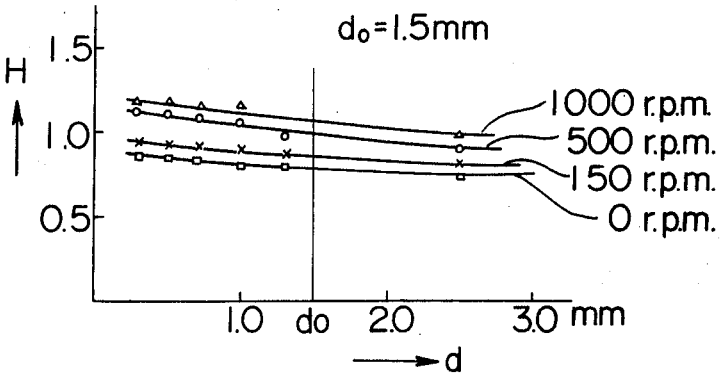
Figures 3, 8:
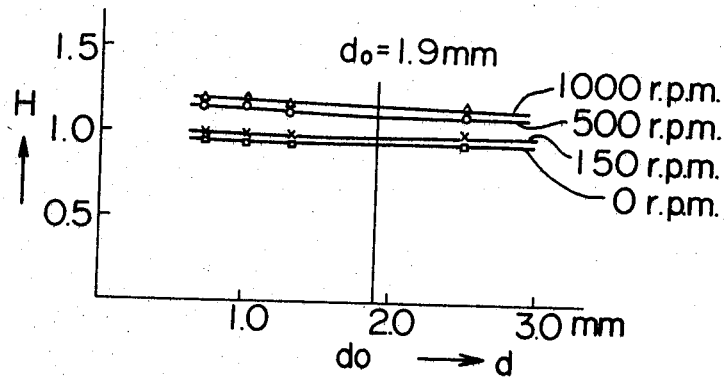
Figures 4, 8:
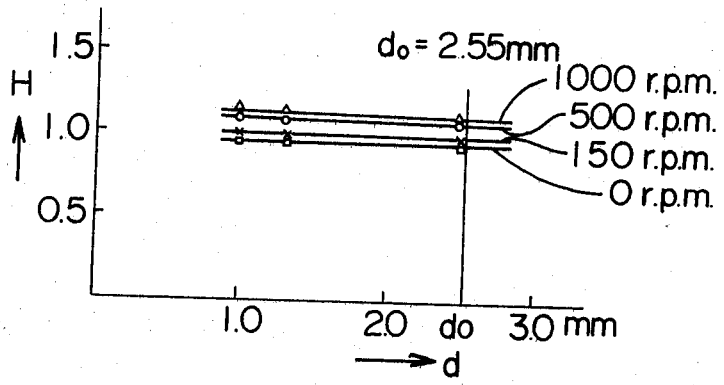

FIGS. 8-1 to 8-4 show the relation of the reflective density (H) of the image developed by using the developing apparatus shown in FIG. 6 to the number of revolutions (rpm) of the roll-like magnet 47 versus varying distances (*d*) with regard to the distance (*a*). The electrostatic latent image is developed using the apparatus shown in FIG. 6 while making the minimum distance (*b*) between the sheet-insertion-guiding plate 53 and the developer-retaining member 42 equal to the distance (*c*) between the surface of the raised portion of the guide roller 54 and the surface of the developer-retaining member 42 and also to the minimum distance (*d*) between the surface of the developer-retaining member 42 and the surface of the sheet-like image-bearing material 51 ($b=c=d$), and changing the number of revolutions (rpm) of the roll-like magnet 47 which has a magnetic flux density of about 500 gauss on the surface of the developer-retaining member 42 and has 12 magnetic poles, and also varying the relation of (*a*) to (*b*) and (*c*). The reflective density (H) of that part of the developed image which corresponds to the darkest part of the original image is measured by means of a microdensitometer (SAKURA PDM-5B). When (*a*) is 0.3, 0.5, 0.7, and 1.0 mm respectively, $d_o$ becomes substantially equal to 1, 1.5, 1.9, and 2.5 mm respectively. In these figures, the image density (H) is plotted on the axis of ordinates, and the distance (*d*), on the axis of abscissas.

FIG. 8-1 shows the relation between H and *d* at $d_o =$ 1 mm according to variations in the number of revolutions of the magnet 47. From this figure, the image density is seen to increase with increasing number of revolutions of the magnet 47 and decreasing $d_o$. In ordinary office copying, it is sufficient that the image density is about 1.0. Accordingly, developed images of good quality can be obtained by the rolling contact when $d_o = 1$ mm and $d_o \geqq d$ and the number of revolutions of the magnet 47 is at least 500 rpm.

FIG. 8-2 shows the relation between H and *d* when (*a*) is adjusted to provide $d_o = 1.5$ mm and the number of revolutions of the magnet 47 is varied. This figure shows the same tendency as in FIG. 8-1. It can be seen that developed images of good quality can be obtained when $d_o = 1.5$ mm and $d_o \geqq d$ and the number of revolutions of the roll-like magnet 47 is at least about 300 rpm.

FIGS. 8-3 and 8-4 show the relation between H and *d* when $d_o$ is rendered equal to 1.9 mm and 2.55 mm respectively by adjusting (*a*), and the number of revolutions of the magnet 47 is changed. The tendency of change in image density (H) according to the variations in the speed of the roll-like magnet 47 is the same as in FIGS. 8-1 and 8-2, but the amount of change in the density (H) with variations in the speed of rotation is seen to decrease markedly. For example, in FIG. 8-1, at $d = 1.0$ mm, the image density (H) varies from 0.7 to 1.05 when the number of rotation changes from 0 to 1000 rpm. The amount of change in the image density is 0.35. On the other hand, in FIG. 8-4, at $d = 1.0$ mm, the image density (H) varies from 0.95 to 1.15 when the number of revolutions changes from 0 to 1000 rpm, showing a difference of only 0.2 in density. By presetting the conditions as shown in FIGS. 8-2 to 8-4, the method of development becomes very stable to changes in the number of revolutions and the distance (*d*). Since the change of the density (H) with the number of revolutions of the roll-like magnet 47 is not so great when the number of revolutions is above 500 rpm. The suitable number of revolutions of the roll-like magnet is 150 to 500 rpm, preferably 300 to 400 rpm in view of the mechanical durability of the rotating parts and of the fact that at high speeds, the developer is scattered and pollutes the environment, and when the number of revolution is 0, the resulting images have somewhat coarse surface textures.

After all, in the apparatus shown in FIG. 6, good images having sufficient density, fine surface texture and high sharpness can be obtained by setting all of (*a*), (*b*) and (*c*) at 0.1 to 1.00 mm, preferably about 0.7 mm and adjusting the number of revolutions of the roll-like magnet 47 to at least 150 rpm, preferably to 300 to 400 rpm. Incidentally, in the measurement of the image density, a relatively highly insulating hard alumina was used as the developer-retaining member 42. A commercially available zinc oxide photographic paper was used as the image-bearing material. It was charged to a potential of about 400 V, exposed imagewise, and developed with a carrierless toner supplied by Tomoegawa Paper Co., Ltd. The developed image was fixed by a heated roller, and then the reflective density (H) of the image was measured.

A further embodiment of this invention will be described with reference to FIG. 9.

Figure 7:
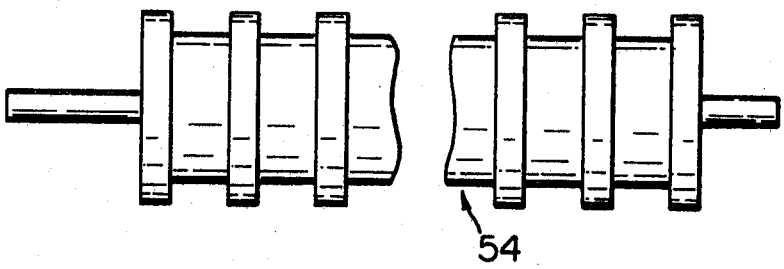
FIG. 7 is a front elevation of a guide roller of the developing apparatus shown in FIG. 6.
Figure 9:
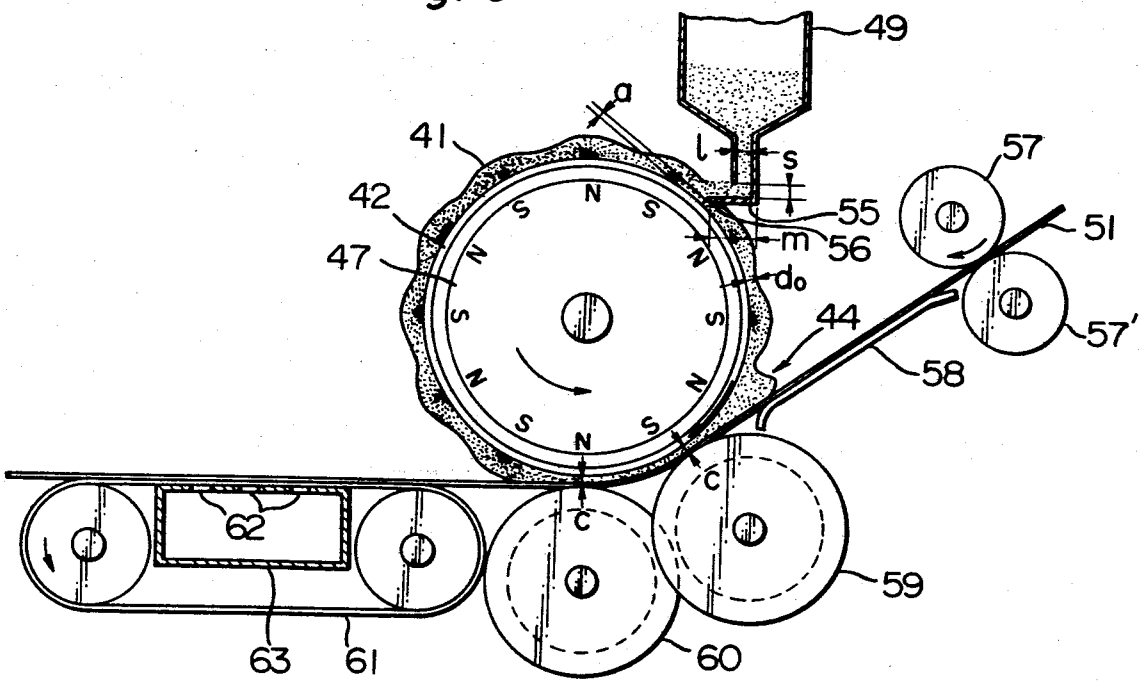
FIGS. 9 to 11 are simplified sectional views of the developing apparatus of this invention.

The developer-container 49 of the developing apparatus shown in FIG. 9 has a developer feed opening with a width of *l* at its bottom. The developer which has flowed down through the feed opening is accumulated temporarily on an L-shaped developer-adjusting plate 55 provided at the lower end of the feed opening. The developer-container 49 and the developer-adjusting plate 55 may be formed in an integral unit. The developer-adjusting plate 55 extends to a point spaced away from the surface of the developer-retaining member 42 by the distance (*a*), and the developer temporarily accumulated on the adjusting plate 55 is attracted in a constant amount by a magnetic force to the surface of the developer-retaining member so that it accumulates on the surface to the height (*a*). By providing a magnetically attractive body 56 near the forward end of the adjusting plate 55, the developer can be stirred at this part. This is advantageous when the developer is susceptible to blocking. The length (*m*) of the horizontal part of the developer-adjusting plate 55, the distance (*s*) between the horizontal part and the developer feed opening, and the width (*l*) of the feed opening somewhat vary according to the particle size of the developer and the force of the magnet 47, etc. When the magnetic strength on the surface of the developer-retaining member is 500 to 1000 gauss and the particle size of the developer is about 5 to 50 microns, it is desirable to set *l* at about 3 to 8 mm, *s* at about 3 to 5 mm, and *m* at about 5 to 15 mm. The sheet-like image-bearing material 51 conveyed by transfer rollers 57 and 57' is guided by a guide plate 58 and two guide rollers 59 and 60 and is brought into rolling contact with the surface of the developer-retaining member 42 through the layer of the developer on the surface of the retaining member, whereby the latent image is developed. The forward end of the guide plate 58 may be constructed in a comb-like form, and the guide rollers 59 and 60 may be rollers having raised and depressed portions as shown in FIG. 7. Preferably, the raised and depressed portions of the guide plate 58 and the guide rollers 59 and 60 are provided in mutually deviated states in a direction perpendicular to the advancing direction of the latent image-bearing material 51, so that non-uniformity in pressure contact between the developer and the image-bearing material ascribable to the raised and depressed portions may be removed. The height (*a*) of the developer adhering to the surface of the developer-retaining member, the distance (*c*) between the guide rollers and the developer-retaining member, and the number of revolutions of the roll-like magnet have the same relation as in the embodiment shown in FIG. 6. The image-bearing material 51 developed and discharged from the developing section can be sent to the fixing section by means of, for example, a porous transfer belt 61 or a transfer means 61 composed of a plurality of transfer belts arranged at intervals in the moving direction which is driven at the same speed as the moving speed of the image-bearing member. A suction duct 63 having a suction opening 62 is provided inwardly of that part at which the transfer means 61 makes contact with the developer-retaining member. The developer-retaining member is conveyed while adhering to the transfer means 61 so that the copied image before fixation may not be damaged. The developer-retaining member 42, the roll-like magnet 47, and the guide rollers 59 and 60 may be constructed in a unit.

The developing method and apparatus of this invention can be used to develop electrostatic latent images formed not only on the surface of a sheet-like image-bearing materials but also those image-bearing materials made of an electrophotographic sheet mounted on the surface of a rotary drum. The latter embodiment will be described by reference to FIG. 10.

Figure 10:
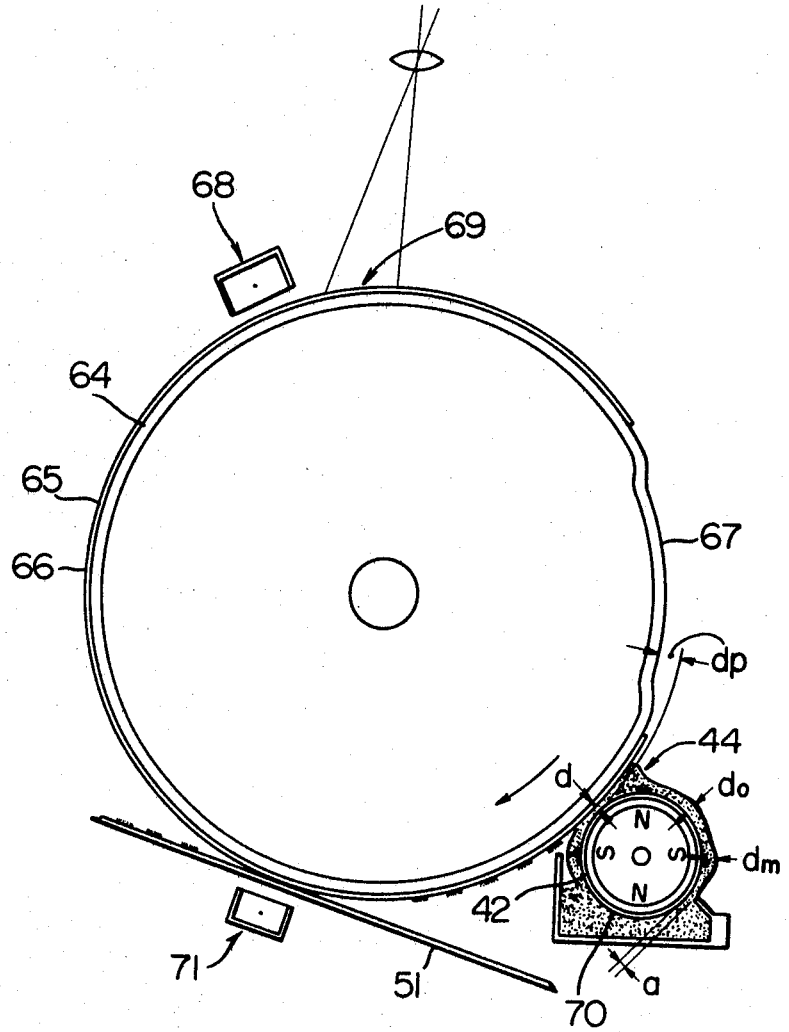

Referring to FIG. 10, an electrostatic photographic sheet 65 which constitutes the image-bearing material is adhered to the surface of a rotary drum 64, thus forming a surface 66 of the image-bearing material of a relatively large diameter and a non-sensitive surface 67 having a relatively small diameter. The photosensitive plate 65 is charged in a predetermined polarity by means of a charging section 68, and an electrostatic latent image is formed on its surface by being exposed properly in an exposing section 69. Then, the plate reaches the developing section. Distance (*d*) which meets the equation $d_o \geqq d$ mentioned above is formed between the surface 66 and the surface of the developer-retaining member 42. Distance ($d_p$) which meets the equation $d_p \geqq d$ mentioned above is formed between the non-sensitive surface 67 of the drum 64 and the surface of the developer-retaining member 42. Hence, the surface 66 of the image-bearing material and the surface 70 of the developer-retaining member make rolling contact with each other through the developer layer to form a developer reservoir zone 44 temporarily upstream of the rolling contact zone. Thus, the electrostatic latent image is developed. When the developing operation has proceeded through one cycle, and the surface 70 faces the non-sensitive 67, the developer in the reservoir zone 44 is carried away from the reservoir zone 44 while being retained by the developer-retaining member by the presence of the distance $d_p$. The toner image on the photosensitive layer is transferred to a copying paper in a transfer section 71.

Figure 11:
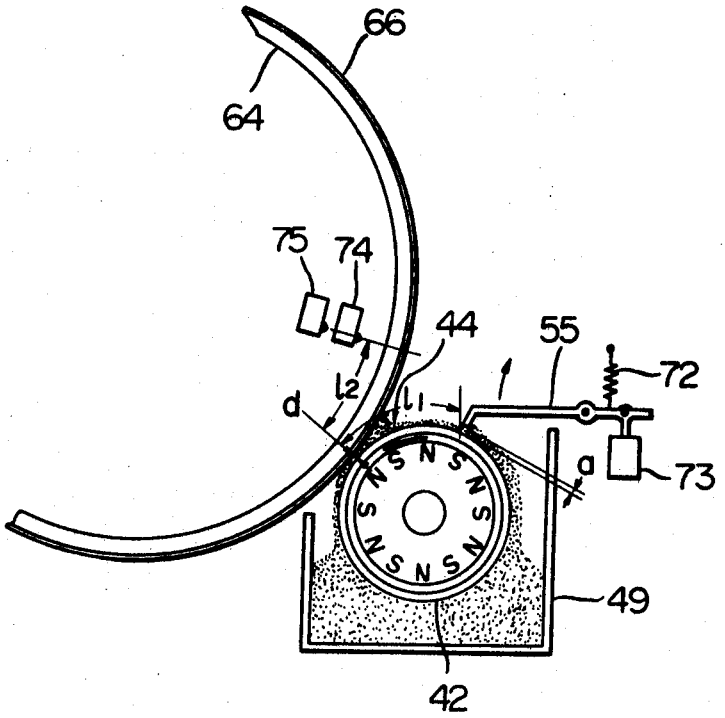

When the electrophotographic plate mounted on the rotary drum is endless, the developer residing in the reservoir zone can be carried away by the developer-retaining member at the end of every developing cycle by controlling the amount of the developer to be fed to the surface of the developer-retaining member. For example, in an embodiment shown in FIG. 11, the surface 66 of an electrostatic latent image-bearing material comprising an electrophotographic layer such as selenium deposited thereon by vacuum evaporation is provided in an endless fashion. The developer-adjusting plate 55 provided above the developer-container 49 is normally urged by an elastic means 72 such as a spring so that its forward end fits to the surface of the developer-retaining member 42. When a control means 73 such as a solenoid is actuated, the adjusting plate overcomes the urging force of the elastic means 72 and departs from the surface of the developer-retaining member 42 by the distance (*a*). In the rolling contact zone between the surface of the developer-retaining member 42 and the surface 66 of the image-bearing material on the rotary drum, the distance (*d*) meeting the equation $d_o \geqq d$ is provided same as mentioned above. Thus, in this embodiment, prior to the start of every cycle of the developing operation, the solenoid 73 is energized to separate the forward end of the adjusting plate from the surface of the developer-retaining member 42 by the distance (*a*). This results in the formation of the desired developer layer on the surface of the developer-retaining member 42. Accordingly, during the developing operation, a developer reservoir zone 44 is formed upstream of the rolling contact zone. Upon the completion of every cycle of the developing operation, the solenoid is deenergized. This results in a close fitting of the forward end of the adjusting plate 55 to the surface of the developer-retaining member 42, and the supply of the developer to the surface of the developer-retaining member 42 is interrupted. Thus, the developer residing in the reservoir zone is carried away by the developer-retaining member 42 through the gap (*d*) between the surface of the developer-retaining member and the surface of the image-bearing material. The energization and deenergization of the solenoid can be performed synchronously with one cycle of the developing operation by providing a means 74 for detecting a standard end for initiation of development and a means 75 for detecting a standard end for completion of development on the side of the rotary drum so that the distance ($l_1$) between the forward end of the adjusting plate 55 and the rolling contact zone is approximately equal to the distance ($l_2$) between the rolling contact zone and the position at which the standard position for initiation or completion of development is detected. It is not always necessary to remove the developer from the reservoir zone in every cycle, but alternatively, the developer residing in the reservoir zone is allowed to overflow spontaneously from the side of the rotary drum so that the developer does not reside in the reservoir zone in an amount exceeding a certain prescribed amount.

Since in this embodiment of using an electrophotographic plate formed on the rotary drum as the image-bearing material, the photosensitive layer and the developer-retaining member are brought into rolling contact with each other through the developer layer, the surface of the photographic plate is not substantially subjected to friction. Accordingly, no frictional flaw occurs on the surface of the photographic plate, and the life of the photographic plate can be prolonged. Furthermore, this embodiment brings about the advantage that images are not disordered by charging of the photographic plate upon friction.

Whilst some specific embodiments of this invention have been described in detail hereinabove, it is obvious that the invention is in no way limited to these embodiments, but various changes and modifications are possible without departing from the spirit and scope of this invention.

What we claim is:

1. A method for developing an electrostatic latent image formed on the surface of an image-bearing material by applying a powdery developer thereto, which comprises bringing the surface of a developer-retaining member retaining a layer of the powdery developer on its surface into rolling contact with the surface of said image-bearing material through the developer in such a relation that a reservoir zone of the developer is formed upstream of and adjacent to the rolling contact zone of both surfaces, and physically disturbing the developer in said reservoir zone to cause the developer to make an irregular motion.

2. The method of claim 1 wherein said rolling contact is effected so that the following relation is met $$d_o \geqq d$$

wherein $d_o$ is the minimum thickness of the layer of the developer retained on the surface of the developer-retaining member, and $d$ is the minimum distance between the surface of the developer-retaining member and the surface of the image-bearing material.

3. The method of claim 1 wherein said developer-retaining member is of a rotatable hollow cylindrical shape and said image-bearing material is sheet-like, and said developer-retaining member is rotated at a predetermined speed and simultaneously said image-bearing material is moved relative to the developer-retaining member at substantially the same speed as the surface speed of the developer-retaining member, thereby to bring the surface of the developer-retaining member into rolling contact with the surface of the image-bearing material.

4. The method of claim 1 wherein said developer-retaining member is of a rotatable hollow cylindrical shape and the image-bearing material is a photosensitive plate mounted on the peripheral surface of a rotary drum, and the developer-retaining member and the rotary drum are rotated in opposite directions to each other thereby to bring the surface of the developer-retaining member into rolling contact with the surface of the image-bearing material.

5. The method of claim 3 wherein the developer in the reservoir zone is disturbed magnetically by rotating a roll-like permanent magnet disposed within said developer-retaining member and being rotatable independently therefrom.

6. The method of claim 5 wherein said permanent magnet has a plurality of poles of opposite polarities arranged alternately on its periphery, and the developer in the reservoir is magnetically disturbed by rotating the roll-like permanent magnet in a direction opposite to the rotating direction of the developer-retaining member.

7. The method of claim 6 wherein the developer is fed upstream of the rolling contact zone to the surface of the developer-retaining surface thereby to adjust the amount of the developer to be retained on the surface of the developer-retaining member.

8. The method of claim 7 wherein the minimum thickness ($d_o$) of the developer layer to be retained on the surface of the developer-retaining member is adjusted to about 0.3 to 2.5 mm, the minimum distance ($d$) between the surface of the developer-retaining member and the surface of the image-bearing material is adjusted to about 0.1 to 1.0 mm, and the roll-like permanent magnet is rotated at a speed of at least 150 rpm.

9. The method of claim 8 wherein said roll-like permanent magnet is rotated at a speed of 300 to 400 rpm.

10. The method of claim 1 wherein the developer is a relatively conductive one-component developer having a resistivity of not more than about $10^{13}$ ohms.cm, and said developer-retaining member has an insulating coating having a resistance of about $10^3$ to $10^9$ ohms per $cm^2$ on its surface.

11. The method of claim 10 wherein said developer has a resistivity of not more than $5 \times 10^{11}$ ohms.cm.

12. The method of claim 10 wherein said coating has a resistance of about $10^4$ to $10^7$ ohms per $cm^2$.

13. The method of claim 10 wherein said coating is a metallic oxide coating.

14. The method of claim 10 wherein the developer-retaining member is grounded.

15. A method for developing an electrostatic latent image formed on the surface of an image-bearing material by applying a powdery developer thereto, which comprises magnetically retaining a layer of a relatively conductive one-component developer having a resistivity of not more than $10^{13}$ ohms.cm on the surface of a hollow cylindrical developer-retaining member having an insulating coating with a resistance of $10^3$ to $10^9$ ohms per $cm^2$ and being kept at a grounded potential by means of a magnet disposed within said developer-retaining member and having a plurality of poles of opposite polarities arranged alternately on its periphery; bringing the surface of said developer-retaining member into rolling contact with the surface of said image-bearing material through a layer of the developer in such a relation that a reservoir zone of the developer is formed at least upstream of and adjacent to the rolling contact zone of both surfaces; and physically disturbing the developer in said reservoir by rotating said magnet.

16. The method of claim 15 wherein the surface coating of said developer-retaining member has a resistance of $10^4$ to $10^7$ ohms per $cm^2$.

17. The method of claim 15 wherein said developer has a resistance of not more than $5 \times 10^{11}$ ohms.cm.

18. The method of claim 15 wherein said magnet is a roll-like permanent magnet having at least 6 poles and a magnetic flux density on the surface of said developer-retaining member of at least 500 gauss.

19. The method of claim 18 wherein the minimum thickness ($d_o$) of the developer layer to be retained on the surface of the developer-retaining member is adjusted to about 0.3 to 2.5 mm, the minimum distance ($d$) between the surface of the developer-retaining member and the surface of the image-bearing material is adjusted to about 0.1 to 1.0 mm, and the roll-like permanent magnet is rotated at a speed of at least 150 rpm.

20. The method of claim 19 wherein the rotating speed of the roll-like permanent magnet is 300 to 400 rpm.

21. The method of claim 15 wherein said coating is a metallic oxide coating.

* * * * *